United States Patent [19]

Desai et al.

[11] 4,374,668

[45] Feb. 22, 1983

[54] GOLD BASED ELECTRICAL MATERIALS

[75] Inventors: Jaydev D. Desai, Clifton Park; William G. Moffatt, Ballston Lake, both of N.Y.

[73] Assignee: The United States of America as represented by the Secretary of the Navy, Washington, D.C.

[21] Appl. No.: 258,829

[22] Filed: Apr. 29, 1981

[51] Int. Cl.[3] ..... C22C 5/02

[52] U.S. Cl. ..... 420/507; 200/266

[58] Field of Search ..... 75/165, 247, 202, 203, 75/206; 200/265, 266

[56] References Cited

U.S. PATENT DOCUMENTS

| | | | |
|---|---|---|---|
| 3,622,310 | 11/1971 | Reinacher et al. | 75/165 |
| 3,709,667 | 1/1973 | Selman et al. | 29/182.5 |
| 3,779,714 | 12/1973 | Nadkarni et al. | 29/182.5 |
| 4,018,599 | 4/1977 | Hill et al. | 75/165 |
| 4,066,819 | 1/1978 | Anderson et al. | 428/472 |
| 4,279,649 | 7/1981 | Fujiwara et al. | 75/173 R X |

FOREIGN PATENT DOCUMENTS

| | | | |
|---|---|---|---|
| 645348 | 7/1962 | Canada | 200/266 |

*Primary Examiner*—L. Dewayne Rutledge
*Assistant Examiner*—David A. Hey
*Attorney, Agent, or Firm*—Robert F. Beers; Frederick A. Wein

[57] ABSTRACT

A gold based electrical contact material comprising an oxide of an oxidizable element in the gold matrix formed by subjecting the solid solution to an oxidizing atmosphere for internally oxidizing the oxidizable element is presented. Such internal oxidation forms hard second phase oxide particles dispersed throughout the solution having high wear resistance, high hardness, high strength and high conductivity with homogeneous and uncontaminated structure.

4 Claims, No Drawings

GOLD BASED ELECTRICAL MATERIALS

BACKGROUND OF THE INVENTION

The present invention relates to low energy slip rings, and more particularly, to gold based contact materials fabricated by internal oxidation for use as slip ring material.

Materials suitable for use in low energy slip rings should have high wear resistance, low contact resistance, and a homogeneous and uncontaminated microstructure. Accordingly, such materials must have high conductivity, high hardness and wear resistance, high tarnish resistance, low contact noise, and little or no tendency towards catalytic formation of friction polymers. In the past, these considerations have led to a virtually exclusive dependence upon gold based materials. Currently used gold based materials utilize cold working, solid solution hardening, precipitation hardening, or order hardening which generally benefits strength, hardness and wear resistance but have detrimental effects on the electrical and chemical properites of gold.

Nickel, cobalt, or cadmimum hardened electroplated gold exhibit high hardness, high wear resistance and have a reasonably high conductivity, but such materials often have included contaminates such as KCN, porosity, codeposited polymers, and the like. Moreover, it is hypothesized that such materials have a nonhomogeneous structure. Additionally, the properties of hardened electroplated gold are strongly dependent upon the substrate and plating conditions. Thus, consistantly high quality electroplates require not easily achieved stringent controls during processing. Accordingly, it is desirable to provide a gold-based material which will exhibit high wear resistance, high hardness, high strength, and high conductivity with a homogeneous and uncontaminated structure.

SUMMARY OF THE INVENTION

Briefly, gold based contact materials fabricated by internal oxidation are presented. A solid solution comprising gold alloyed with a oxidizable element is exposed to an oxidizing atmosphere at a predetermined elevated temperature below the melting temperature of the solid solution to form hard, second phase oxide particles by internal oxidation. These oxide particles form within the alloy by preferential oxidation of the oxidizable element and remain in the crystal matrix with an effect of a simultaneous increase in strength, hardness, wear resistance and electrical conductivity of the alloyed material.

OBJECTS OF THE INVENTION

Accordingly, it is an object of the present invention to provide gold based electrical contact materials fabricated by internal oxidation for providing higher wear resistance, higher hardness, higher strength and higher conductivity with a homogeneous and uncontaminated structure.

Another object of the present invention is to provide gold based electrical contact materials fabricated by exposing a solid solution of gold and cerium or hafnium to an oxidizing atmosphere of oxygen at an elevated temperature below the melting temperature of the solid solution to form hard, second phase oxide particles of cerium or hafnium by internal oxidation.

Further objects and advantages of the present invention will become apparent as the following description proceeds and the features of novelty characterizing the invention will be pointed out with particularity in the claims annexed to and forming a part of this specification.

DETAILED DESCRIPTION OF THE PREFERRED EMBODIMENT

The present invention relates to materials suitable for low energy slip ring applications, and more particularly, to gold based electrical contact materials produced by internal oxidation.

Oxide dispersion strengthened gold having $Al_2O_3$, $CeO_2$, $TiO_2$, $HfO_2$ and $ZrO_2$ and the like as the second phase have been prepared in the prior art by mixing and compacting gold and oxide powders or by chemical means. Preparation of oxide dispersion strengthened gold by internal oxidation yields superior contact properties.

The contact material is prepared by casting an alloy of gold with a second element, e.g., Al, Ti, Zr, Ta, Ce, Hf and the like which goes into solution and can later form stable oxides, when the alloys are subjected to internal oxidation treatment. The alloy is heated under oxidizing conditions to preferentially oxidize the solute metal to form in situ particles of hard, solute metal oxide in the matrix material without oxidation of the gold. The matrix material is relatively noble compared to the solute metal so that the solute metal is preferentially oxidized.

The preferential oxidation or removal of the solute element from solution to form the oxide particles will result in simultaneous increase in the strength, hardness, wear resistance and electrical conductivity of the material. The material will also exhibit a relatively homogeneous and uncontaminated structure and as compared to conventional powder metallurgy approach, will have finer and more uniformily distributed second phase oxide particles and better coherency and bonding at the gold matrix-particle interface. Thus, the hardening and wear resisting characteristics will be exhibited throughout the material and the electrical conductivity will not be impaired by the second hard phase. The microstructure consisting of fine, uniformly distributed oxide particles in gold exhibit excellent electrical contact characteristics since the conducting areas within a contact zone, although only a few microns in diameter, will each contain several of these oxide particles along with the gold matrix.

More particularly, the solid solution can be prepared by casting and the alloy can be subjected to one or more different oxidizing conditions. For example, a gold-0.1% by weight of aluminum in solid solution with 99.9% pure gold is produced by melting and casting the material in a copper mold in an argon atmosphere. The alloys can then be subjected to oxidizing atmospheres containing oxygen as follows:

600° C. for 50 hrs. of flowing air,
600° C. for 100 hr. of flowing air,
1,000° C. for 20 hrs. of flowing air,
1,000° C. for 50 hrs. of flowing air,
1,000° C. for 20 hrs. of flowing oxygen, or
1,000° C. for 50 hrs. of flowing oxygen.

All alloys, after oxidizing heat treatment, exibited particles in the gold matrix as seen in optical metallography. Alloys subjected to 1,000° C. for 50 hrs. in flowing oxygen exhibited the best distribution of oxide particles.

The alloy hardness ranged from 40 to 52 Diamond Pyramid Hardness at 100 gram load with 10 seconds load duration.

Thus, a gold based electrical contact material containing an oxide of a oxidizable element produced by internally oxidizing the oxidizable element is presented. Such internal oxidation forms hard second phase oxide particles dispersed throughout the matrix having high wear resistance, high hardness, high strength and high conductivity with homogeneous and uncontaminated structure.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

What is claimed as new and desired to be secured by Letters Patent is:

1. A gold based electrical contact material comprising:

a solid solution consisting essentially of gold, and residual unoxidized cerium and a dispersion of cerium oxide, the cerium oxide having been formed by internal oxidation by subjecting the solid solution to an oxidizing atmosphere of oxygen at a temperature below the melting temperature of the solid solution.

2. A gold based electrical contact material produced by a process comprising the steps of:

providing a solid solution consisting essentially of gold and cerium, and subjecting the solid solution to an oxidizing atmosphere of oxygen for a predetermined period of time so that at least a portion of the cerium is oxidized by internal oxidation to form hard, second phase oxide particles dispersed in the solid solution.

3. A gold based electrical contact material comprising:

a solid solution consisting essentially of gold, and residual unoxidized hafnium and a dispersion of hafnium oxide, the hafnium oxide having been formed by internal oxidation by subjecting the solid solution to an oxidizing atmosphere of oxygen at a temperature below the melting temperature of the solid solution.

4. A gold based electrical contact material produced by a process comprising the steps of:

providing a solid solution consisting essentially of gold and hafnium, and subjecting the solid solution to an oxidizing atmosphere of oxygen for a predetermined period of time so that at least a portion of the hafnium is oxidized by internal oxidation to form hard, second phase oxide particles dispersed in the solid solution.

* * * * *